US005440225A

United States Patent [19]

Kojima

[11] Patent Number: 5,440,225

[45] Date of Patent: Aug. 8, 1995

[54] CORE FOR COIL DEVICE SUCH AS POWER TRANSFORMERS, CHOKE COILS USED IN SWITCHING POWER SUPPLY

[75] Inventor: Hideki Kojima, Tsurugashima, Japan

[73] Assignee: Toko Kabushiki Kaisha, Tokyo, Japan

[21] Appl. No.: 21,867

[22] Filed: Feb. 24, 1993

[30] Foreign Application Priority Data

Feb. 24, 1992 [JP] Japan ..... 4-017251 U

[51] Int. Cl.[6] ..... H01F 40/04

[52] U.S. Cl. ..... 323/359; 323/362; 336/178

[58] Field of Search ..... 336/126, 127, 178, 165; 323/359, 362

[56] References Cited

U.S. PATENT DOCUMENTS

| | | | |
|---|---|---|---|
| 2,553,554 | 5/1951 | Dierstein | 336/178 |
| 3,546,571 | 12/1970 | Fletcher et al. | 336/178 |
| 3,603,864 | 12/1969 | Thaler | 336/178 |
| 3,820,238 | 6/1974 | Caputo et al. | 29/606 |
| 3,924,174 | 12/1975 | Fahrner | 323/262 |
| 4,827,237 | 5/1989 | Blackburn | 336/212 |
| 5,122,947 | 6/1992 | Hishiki | 363/61 |
| 5,155,676 | 10/1992 | Spreen | 363/126 |

FOREIGN PATENT DOCUMENTS

| | | | |
|---|---|---|---|
| 4168712 | 12/1968 | Japan | 336/178 |

*Primary Examiner*—Thomas M. Dougherty
*Assistant Examiner*—Adolf Berhane
*Attorney, Agent, or Firm*—Cushman, Darby & Cushman

[57] ABSTRACT

The invention pertains to a core for a coil device of a switching power supply which can avoid accidental breakage of the portion where the core cross-sectional area narrows. When one core segment is rotated 180 degrees about its center axis in the long direction of one leg 2, the projection 51 of one core segment 1A and the projection 52 of another core segment 1B, and the indentation 61 of the one core segment 1A and the indentation 62 of the other core segment 1B are aligned so as to mutually overlap. The characteristics of a coil device can be controlled by the contacting surface areas of both core segment projections or by spacing between the projections. Since the cross-sectional area of each core projection can be made wider, accidental breakage of the core projection does not occur easily.

13 Claims, 4 Drawing Sheets

CORE FOR COIL DEVICE SUCH AS POWER TRANSFORMERS, CHOKE COILS USED IN SWITCHING POWER SUPPLY

BACKGROUND OF THE INVENTION

1. Industrial Field of the Invention

The present invention relates to a core for a coil device such as power transformers, choke coils used in switching power supply.

2. Prior Art

Generally, in constructing a power transformer for a switching power supply, two E-shaped segments are combined to form the core. A space is provided in the core forming the magnetic circuit, or the core cross-sectional area through which the magnetic circuit passes is portionately narrowed, so that magnetic flux leaks to the outer side of the core. This prevents magnetic saturation of the core even with increased current, up to a certain limit, due to load fluctuation.

FIG. 7 indicates a top view of a conventional power transformer core for a switching power supply that is composed of two E-shaped segments.

A projection 32 is provided at the end of a leg 31 in the center of an E-segment 30. This projection 32 contacts the flat end of the central leg 34 of another E-segment 33. Both outer legs of the E-segments 30 and 33 have flat ends, which are mutually in close contact. The legs 31 and 34 are inserted in the coil winding bobbin.

When a core is constructed in this manner, as the coil current increases, the projection 32, which has a narrowed cross-sectional area, is initially saturated. Since magnetic flux leaks to the perimeter of the projection 32, the overall core does not saturate magnetically until a large current is reached.

FIG. 8 is a characteristic indicating the relationship between a power transformer coil inductance L and current I. The solid line indicates the response when the projection 32 area is narrow.

When the current I is small, the inductance L increases. Even if the current I increases, since the core is not easily saturated, the inductance L exists up to a large current.

However, as indicated by the dotted line, if the projection 32 area is widened, although the inductance L increases when the current I is small, at a comparatively small current the overall core becomes magnetically saturated and inductance L ceases to exist.

The characteristic indicated by the solid line in FIG. 8 is sought in coil devices such as power transformers, choke coils used in switching power supply. Under the conventional method, to obtain such a characteristic, the cross-sectional area of the projection 32 needs to be narrowed.

However, when the cross-sectional area of the projection 32 is made narrow, the projection 32 is easily broken during core formation, and the core yield is reduced. Also in assembling a core with a narrow projecting 32, damage occurs easily and the core often needs to be rejected.

SUMMARY OF THE INVENTION

Problems resolved by the invention

This invention provides a core for use in a coil device for a switching power supply which can eliminate accidental damage of the narrowed section of the cross-sectional area.

Measures for resolving the problem

The coil device such as power transformers, choke coils used in the switching power supply of this invention comprises two core segments with adjoining legs of the same cross-sectional shape;

a first leg of these legs possesses a flat shaped end, the ends of the two core segments are mutually closely adjoined;

and a second leg that possesses an end of a step difference which forms oppositely faced projections and indentations, and mutually adjoin so that the indentations are at opposite positions with respect to the center axes of the legs.

PREFERRED EMBODIMENT OF THE INVENTION

Figure 1:
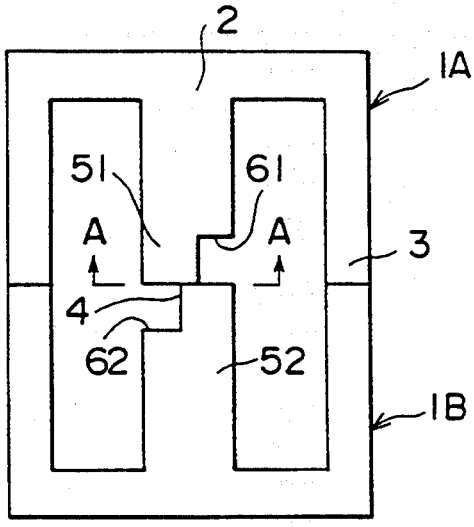
FIG. 1 indicates a top view of an embodiment of this invention as a core for a coil device.
Figure 2:
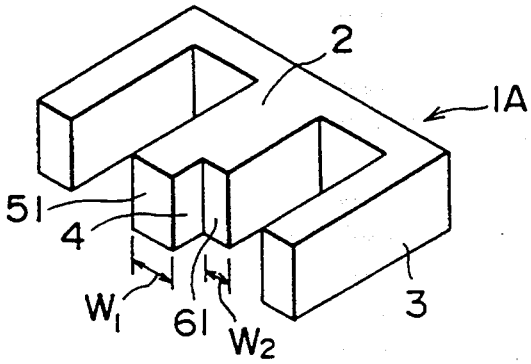
FIG. 2 is an oblique view of one segment composing the core.
Figure 3:
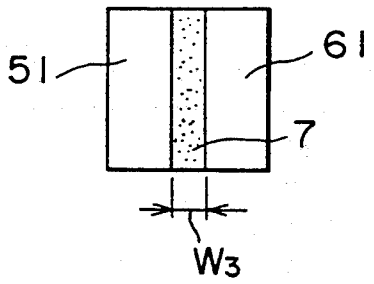
FIG. 3 is a view along axis A—A of the adjoining sections of FIG. 1.

As shown in FIGS. 1, 2, and 3, an embodiment of this invention as a core for a coil device of a switching power supply is illustrated. FIG. 1 is a top view, FIG. 2 is an oblique view of one core segment and FIG. 3 is a descriptive view.

As indicated in FIG. 1, the power transformer core of this invention is composed by combining two equally shaped E-shape core segments 1A and 1B.

FIG. 2 is an oblique view of one core segment 1A; the cross-sectional shape of the center leg 2 and both outer legs 3 are rectangular. All the legs are the same length. Also, the cross-sectional area of the end legs 3 is the same.

The end of the center leg 2 is divided by a step difference 4 formed into projection 51, extending from the front face of indentation 61 to the front face of projection 51. The step difference 4 is lengthened across the cross-section of the leg 2 opposing perimeters, the projection 51 width W1 is wider than the indentation width W2.

The shape of another E-shaped core segment 1B is entirely the same as the E-shaped core segment 1A, and these are combined to compose the same core. However, different symbols are used herein to facilitate this description.

The tops of the central legs 2,2 of the respective cores 1A and 1B adjoin each other to contact, and the tops of outer legs 3,3 intimately contact each other.

When one core segment is rotated 180 degrees about its center axis in the longitudinal direction of the center leg 2, the projection 51 of core segment 1A and the projection 52 of core segment 1B, and the indentation 61 of core segment 1A and the indentation 62 of core segment 1B are aligned so as to mutually overlap.

Accordingly, as shown in FIG. 3 depicting a cross-sectional view along axis A—A in FIG. 1, the projections 51 and 52 contact each other at a slender area 7 which is depicted with small dots. The width W3 of the slender area 7 equals to the difference between the widths W1 and W2, thus the slender area 7 forms a line where the widths W1 and W2 are equal.

Figure 4:
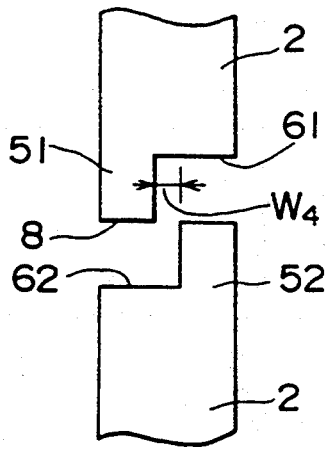
FIG. 4 is a descriptive view of the adjoining sections.

As shown in FIG. 4, there is no contacting area such as the area 7 between the projections 51 and 52 where the width W1 is smaller than the width W2. Projections 51 and 52 each have an end face 8. The positions of the end face 8 are at the same point along the central axis.

In the case where the area 7 exists, the extent of the area 7 through which magnetic flux passes can be varied by varying the width W3. On the other hand, in the case where there is no such area 7, leakage flux can be varied by varying the gap W4 between the projections 51 and 52 in FIG. 4.

Thus, the characteristics of inductance L and coil current I can be varied by varying the state of the magnetic path, namely the leakage flux or the cross-sectional area of the core through which magnetic flux passes.

In conventional cores, a projection is provided at one of the cores so as to vary the state of the magnetic path by varying the extent of the cross-sectional area of the projection. By contrast, according to the present invention, the state of the magnetic path is varied by varying the extent of the contacting area between the projections provided at both the ends of two cores.

Figure 7:
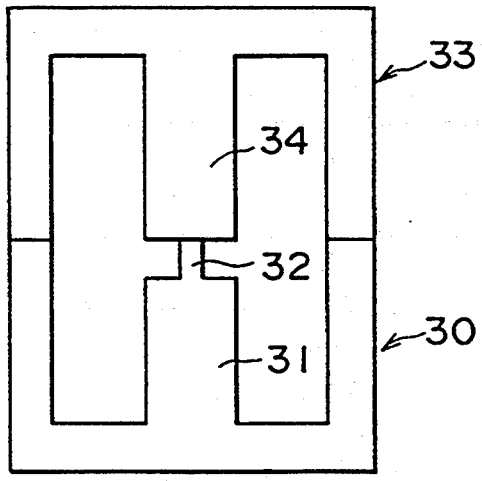
FIG. 7 (PRIOR ART)
Figure 8:
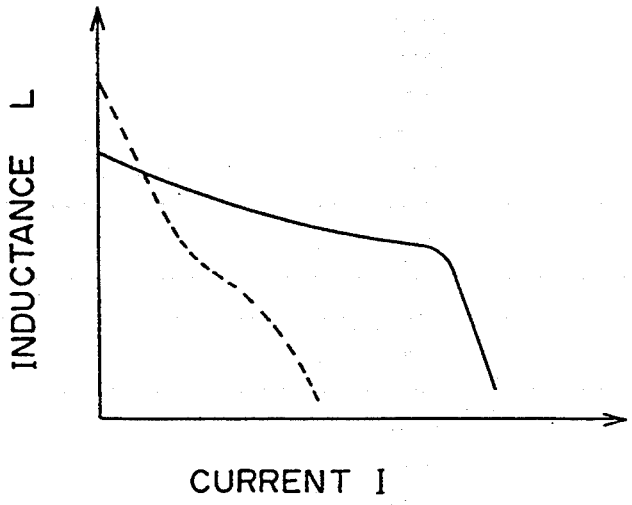
FIG. 8 is a response graph indicating the relationship between an inductance and current of a coil device.

To make small the extent of the area 7 is to make small the cross-sectional area of the projection 32 shown in FIG. 7. However, according to the present invention, the cross-sectional areas of the projections of the respective cores can be kept large while still making the extent of the area 7 small. Accordingly, the strength of the projections of the respective cores is improved so that accidental damage will be eliminated. Even in the embodiment shown in FIG. 4, the cross-sectional area of the projections of the respective cores can be large and the strength is improved because the gap W4 is small.

Figure 5:
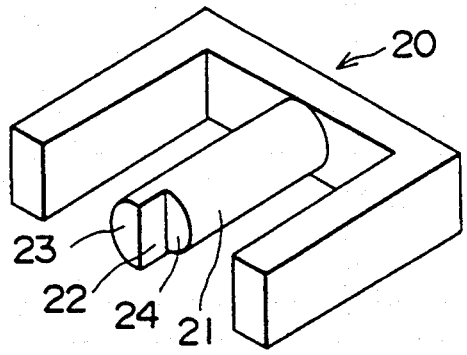
FIG. 5 is an oblique view of another shape for an embodiment of this invention as a core for a coil device, FIG. 6 indicates a top view of another embodiment of this invention as a core for a coil device, FIG. 7 indicates a top view of a conventional core for a coil device.

FIG. 5 is a perspective view of another embodiment of the present invention. In this embodiment, a central leg 21 of an E-type core 20 has a circular cross-section, and there is a step difference 22 to provide a projection 23 and an indentation 24 at the end of the central leg 21.

Thus, the cross-section of the central leg of a core can be circular, square or other shapes.

In other words, with respect to the center axis of the center legs 2, the segments are adjoined so that the projections 51 and 52, and indentations 61 and 62, are at opposite positions.

Also, in this embodiment although only the center leg is formed by a step difference into projection and indentation shapes, such forming can also be applied to the left and right legs.

Furthermore, the core can be made so that the lengths of the E-shaped core legs are not the same. For instance, the center leg longitudinal direction can be made shorter compared to the other legs, and the end face positions of both core segments in the leg longitudinal direction can be separated.

Figure 6:
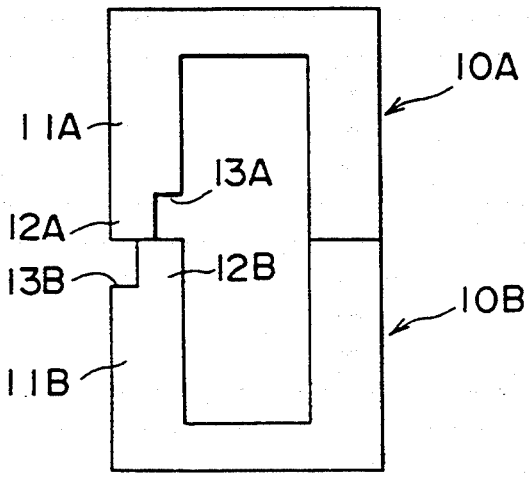

FIG. 6 indicates a top view of another embodiment of this invention as a core for a coil device. This embodiment is composed by combining two U-shaped segments. On one leg 11A of a U-shaped core segment 10A, a projection 12A and an indentation 13A are formed. On one leg 11B of another U-shaped core segment 10B, a projection 12B and an indentation 13B are formed. When either legs 11A or 11B is rotated 180 degrees about its center axis, the projections 12A and 12B and the indentations 13A and 13B at the ends of the legs 11A and 11B are aligned so as to mutually overlap.

The other legs of the U-shaped core segments 10A and 10B have the same cross-sectional areas and are closely adjoined. In this manner, U-shaped core segments can be joined to compose a core for a coil device of this invention.

EFFECTS OF THE INVENTION

As mentioned above, the core for a coil device of this invention comprises two core segments that possess adjoining first legs and second legs of the same cross-sectional shape, being provided with a projection and an indentation on the ends of the second legs. The two core segments are joined by rotating one of the segments 180 degrees about the leg center axis, so that the corresponding projections and indentations of the leg ends overlap in the longitudinal direction.

The characteristics of a coil device such as transformers, choke coils used in switching power supply can then be controlled by the contacting surface areas of both core segment projections or by narrow spacing between the projections.

Consequently, since the areas of the projections of the core segments can be made wider, strength is improved and accidental breakage during forming does not easily occur. Therefore, production yield is improved. Also breakage during assembly is reduced and rejected cores can be avoided.

An additional advantage is that two completely identical core segments can be used when combining E-shaped core segments formed with projections and indentations provided for the center legs, thus reducing the core segment types that need to be manufactured.

What is claimed is:

1. A core for a switching power supply coil device comprising:

a first core segment including a plurality of spaced legs having respective distal ends and a center leg having a longitudinal central axis and a distal end defined by an indented portion and a projecting portion;

a second core segment including a plurality of spaced legs having respective distal ends and a center leg having a longitudinal central axis and a distal end defined by an indented portion and a projecting portion;

wherein said first and second core segments are constructed and arranged to oppose each other such that said respective distal ends of said plurality of spaced legs of said first core segment correspond to and closely contact said respective distal ends of said plurality of spaced legs of said second core segment; and wherein said first and second core segments are constructed and arranged to oppose each other such that said projecting portion of said first core segment partially contacts said projecting portion of said second core segment, said indented portion of said first core segment opposes and is spaced from said projecting portion of said second core segment, and said indented portion of said second core segment opposes and is spaced from said projecting portion of said first core segment.

2. A core as recited in claim 1, wherein said first and second core segments are constructed and arranged such that said central axis of said first core segment and said central axis of said second core segment are collinear, and said indented portion of said first core segment and said indented portion of said second core segment are positioned on opposite sides of said central axes.

3. A core as recited in claim 2, wherein said plurality of spaced legs of said first core segment and said plurality of spaced legs of said second core segment have the same cross-sectional shape.

4. A core as recited in claim 3, wherein said center leg of said first core segment and said center leg of said second core segment have the same cross-sectional shape.

5. A core as recited in claim 1 or 4, wherein said distal ends of said plurality of spaced legs of said first core segment and said distal ends of said plurality of spaced legs of said second core segment are flat.

6. A core as recited in claim 5, wherein said first core segment and said second core segment are E-shaped and have said respective center legs positioned intermediate two respective spaced legs.

7. A core as recited in claim 6, wherein said center legs of said first core segment and said second core segment have circular cross sections.

8. A core for a switching power supply coil device comprising:

a first core segment including a first leg having a distal end and a second leg having a longitudinal central axis and a distal end defined by an indented portion and a projecting portion;

a second core segment including a first leg having a distal end and a second leg having a longitudinal central axis and a distal end defined by an indented portion and a projecting portion;

wherein said first and second core segments are constructed and arranged to oppose each other such that said distal end of said first leg of said first core segment corresponds to and closely contacts said distal end of said first leg of said second core segment; and wherein said first and second core segments are constructed and arranged to oppose each other such that said projecting portion of said first core segment partially contacts said projecting portion of said second core segment, said indented portion of said first core segment opposes and is spaced from said projecting portion of said second core segment, and said indented portion of said second core segment opposes and is spaced from said projecting portion of said first core segment.

9. A core as recited in claim 8, wherein said first core segment and said second core segment are U-shaped.

10. A core as recited in claim 9, wherein said first and second core segments are constructed and arranged such that said central axis of said first core segment and said central axis of said second core segment are collinear, and said indented portion of said first core segment and said indented portion of said second core segment are positioned on opposite sides of said central axes.

11. A core as recited in claim 10, wherein said first leg of said first core segment and said first leg of said second core segment have the same cross-sectional shape.

12. A core as recited in claim 11, wherein said second leg of said first core segment and said second leg of said second core segment have the same cross-sectional shape.

13. A core as recited in claim 12, wherein said distal end of said first leg of said first core segment and said distal ends of said first leg of said second core segment are flat.

* * * * *